US008659528B2

(12) United States Patent
Hara

(10) Patent No.: US 8,659,528 B2
(45) Date of Patent: Feb. 25, 2014

(54) ELECTRO-OPTICAL DEVICE DRIVEN BY POLARITY REVERSAL DURING EACH SUB-FIELD AND ELECTRONIC APPARATUS HAVING THE SAME

(75) Inventor: Hiroyuki Hara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 495 days.

(21) Appl. No.: 12/943,039

(22) Filed: Nov. 10, 2010

(65) Prior Publication Data

US 2011/0115768 A1 May 19, 2011

(30) Foreign Application Priority Data

Nov. 13, 2009 (JP) ..... 2009-259743

(51) Int. Cl.
*G09G 3/36* (2006.01)

(52) U.S. Cl.
USPC ..... 345/96

(58) Field of Classification Search
USPC ..... 345/96
See application file for complete search history.

(56) References Cited

U.S. PATENT DOCUMENTS

| | | | | |
|---|---|---|---|---|
| 7,084,861 | B2 | 8/2006 | Iisaka | |
| 2005/0088370 | A1* | 4/2005 | Shigeta et al. | 345/60 |
| 2008/0278468 | A1* | 11/2008 | Hosaka et al. | 345/205 |
| 2009/0002295 | A1* | 1/2009 | Hosaka | 345/87 |
| 2009/0121994 | A1* | 5/2009 | Miyata | 345/89 |
| 2009/0195561 | A1 | 8/2009 | Iisaka et al. | |

FOREIGN PATENT DOCUMENTS

| | | | |
|---|---|---|---|
| JP | 2003114661 | A | 4/2003 |
| JP | 2005025048 | | 1/2005 |
| JP | 2008122840 | | 5/2008 |
| JP | 2008287063 | A | 11/2008 |

* cited by examiner

*Primary Examiner* — Long D Pham
(74) *Attorney, Agent, or Firm* — Lowe Hauptman & Ham, LLP

(57) ABSTRACT

An electro-optical device includes: a data line driver applying the signal potential in such a manner that a writing polarity is reversed more than once in the field time period, and the writing polarity of each of sub field time periods making up a certain field time period is the opposite of the writing polarity of the corresponding one of sub field time periods making up the next field time period; a scanning line driver applying the scanning signal in such a manner that a total length of the sub field time periods in which writing in one polarity is performed in each cycle of two consecutive fields one of which is an odd field and the other of which is an even field is different from a total length of the sub field time periods in which writing in the other polarity is performed in the each cycle of two consecutive fields.

3 Claims, 11 Drawing Sheets

FIG. 4

| GRAY SCALE LEVEL | SUB FIELD sf1 | sf2 | sf3 | sf4 | sf5 | sf6 | sf7 | sf8 |
|---|---|---|---|---|---|---|---|---|
| 0 | 0 | 0 | 0 | 0 | 0 | 0 | 0 | 0 |
| 1 | 1 | 0 | 0 | 0 | 0 | 0 | 0 | 0 |
| 2 | 1 | 0 | 0 | 0 | 1 | 0 | 0 | 0 |
| 3 | 0 | 1 | 0 | 0 | 0 | 0 | 0 | 0 |
| 4 | 0 | 1 | 0 | 0 | 1 | 0 | 0 | 0 |
| 5 | 0 | 1 | 0 | 0 | 1 | 0 | 1 | 0 |
| 6 | 0 | 1 | 0 | 0 | 0 | 1 | 0 | 0 |
| 7 | 0 | 1 | 0 | 1 | 0 | 0 | 0 | 0 |
| 8 | 0 | 1 | 1 | 1 | 0 | 0 | 0 | 0 |
| 9 | 0 | 1 | 1 | 1 | 0 | 0 | 1 | 0 |
| 10 | 1 | 1 | 1 | 1 | 0 | 0 | 0 | 0 |
| 11 | 1 | 1 | 1 | 1 | 0 | 0 | 1 | 0 |
| 12 | 1 | 1 | 1 | 1 | 1 | 1 | 0 | 0 |
| 13 | 1 | 1 | 1 | 1 | 1 | 0 | 1 | 1 |
| 14 | 1 | 1 | 1 | 1 | 1 | 1 | 0 | 1 |
| 15 | 1 | 1 | 1 | 1 | 1 | 1 | 1 | 1 |

1 ON 0 OFF

ELECTRO-OPTICAL DEVICE DRIVEN BY POLARITY REVERSAL DURING EACH SUB-FIELD AND ELECTRONIC APPARATUS HAVING THE SAME

RELATED APPLICATIONS

The present application is based on, and claims priority from, Japanese Application Number 2009-259743, filed Nov. 13, 2009, the disclosure of which is hereby incorporated by reference herein in its entirety.

BACKGROUND

1. Technical Field

The present invention relates to a method of driving an electro-optical device that uses an electro-optical material such as liquid crystal, the electro-optical device, and an electronic apparatus.

2. Related Art

Liquid crystal is known as an example of electro-optical materials that have optical characteristics that change depending on electric energy. The transmission factor of liquid crystal changes as a voltage applied changes. The change in the transmission factor occurs due to a change in the orientation state of liquid crystal molecules depending on the voltage applied. As the characteristics of liquid crystal, its orientation state is less liable to return to an original state when a direct-current voltage is applied for a long period of time. In consideration of the above characteristics, an alternating-current driving method is generally used in a liquid crystal display device, which uses liquid crystal as its display medium. In the AC driving, the polarity of a voltage that is applied to liquid crystal elements, which constitute a kind of electro-optical elements, is reversed in an alternating manner.

Such a liquid crystal display device typically includes a plurality of scanning lines, a plurality of data lines, and a plurality of pixels that are provided at areas corresponding to respective intersections of the scanning lines and the data lines. Each of the plurality of pixels includes a liquid crystal element. The liquid crystal element includes a pixel electrode, a counter electrode, and liquid crystal. The liquid crystal is sandwiched between the pixel electrode and the counter electrode. As a method for inverting a voltage that is applied to a liquid crystal element, a technique for reversing the polarity of a data potential, which is applied through a data line, with the potential of a counter electrode (hereinafter referred to as "counter electrode potential") being fixed is known in the art. In the known technique, the polarity of the data potential is reversed with respect to the counter electrode potential, which is the center of the reversal.

Specifically, in the technical field of such a liquid crystal display device, the following technique is disclosed in, for example, JP-A-2003-114661 as a method that takes the place of a voltage modulation scheme for performing grayscale display. One field is divided into a plurality of sub fields. Either an ON voltage or an OFF voltage is applied to a pixel (liquid crystal element) in each of the sub fields. The percentage of time during which the ON voltage (or the OFF voltage) is applied to the pixel in the field is changed for grayscale display. The grayscale-displaying technique is called as a digital time-division drive scheme. In connection with a liquid crystal display device that uses such a sub field, a technique for performing grayscale display while weighting the time periods of sub fields is disclosed in, for example, JP-A-2008-287063. It is known that the disclosed technique makes it possible to express a larger number of gray scale levels in grayscale display with a smaller number of sub fields by actively utilizing the transient response characteristics of liquid crystal.

However, the related art disclosed in JP-A-2003-114661 and JP-A-2008-287063 has the following problem. In these techniques, a switching element such as a thin film transistor is usually used in order to control the time of application of an ON voltage or an OFF voltage to a pixel or a pixel electrode accurately. That is, the switching of a switching element between an ON state and an OFF state is utilized to control the time of application of a voltage to a pixel. However, it is known that a phenomenon called as pushdown occurs during the switchover of the state of a switching element. Pushdown, which is also called as a "field-through" phenomenon or an "overrun" phenomenon, occurs as follows. For example, an n-channel type transistor is used as the switching element. When the switch state of the transistor changes from an ON state to an OFF state, the voltage level of the drain electrode of the transistor drops due to parasitic capacitance between the gate electrode and the drain electrode thereof. Therefore, the voltage level of the pixel electrode connected to the drain electrode drops. Pushdown is a phenomenon of such potential dropping. If no measure were taken against such a phenomenon, the effective value of a voltage applied to the liquid crystal element during writing in negative polarity would be slightly larger than the effective value of a voltage applied to the liquid crystal element during writing in positive polarity. Consequently, without any measure taken against such a phenomenon, a direct-current component would be generated as a predictable problem. The generation a direct-current component increases the risk of the burn-in of a display screen.

To avoid such a problem, in some of related art, the level of a voltage applied to a counter electrode (counter electrode potential) is preset into a value that can offset a potential variation that will arise due to the pushdown explained above. That is, the voltage level is shifted from the center level between two polarities in anticipation of the generation of a direct-current component, thereby offsetting the effects of pushdown. By this means, it is possible to make the effects of pushdown less serious to some extent. However, such a solution of related art is sometimes not so effective in a practical sense. There are various reasons why the above solution might not be so effective practically. For example, according to the solution of related art, "the effects of pushdown" have to have been determined accurately in advance as a prerequisite for setting the voltage level of the counter electrode at an appropriate value at least in principle. However, it is practically difficult to meet the preconditions. Moreover, it is not supposable that the voltage level of the counter electrode will be changed from time to time depending on some circumstances. This is partially because the changing of the counter electrode potential would have a significant impact on other settings and partially because it is uncertain whether the effects of pushdown could be really offset or not due to the reason described above even if the counter electrode potential were changed. To sum up the matter, the solution of related art has a disadvantage in that its flexibility as a measure for effectively avoiding the adverse effects of pushdown is rather limited.

SUMMARY

An advantage of some aspects of the invention is to provide a method of driving an electro-optical device, the electro-optical device, and an electronic apparatus that can provide a solution to at least a part of the above problem without any limitation thereto.

As a first aspect of the invention, a method of driving an electro-optical device has the following features. The electro-optical device includes a plurality of scanning lines, a plurality of data lines, and a plurality of pixels provided at areas corresponding to respective intersections of the scanning lines and the data lines. Each of the pixels includes an electro-optical element and a switching element. The electro-optical element includes a pixel electrode, a counter electrode, and an electro-optical material sandwiched between the pixel electrode and the counter electrode. The switching element is provided between the pixel electrode and the data line. The switching element is controlled in such a manner that it is put into either an ON state or an OFF state. A scanning signal that is supplied through the scanning line is used for controlling the state of the switching element. The driving method includes: sequentially supplying the scanning signal for putting the switching element into the ON state through the plurality of scanning lines in each of a plurality of sub field time periods, the plurality of sub field time periods making up a field time period, which is a period of time required for displaying one picture unit of an image, the pixels being selected on a scanning-line-by-scanning-line basis by sequentially supplying the scanning signal; and writing a signal potential that indicates a voltage level for an image that is to be displayed into each of the pixel electrodes of the pixels selected through the corresponding one of the plurality of data lines, the signal potential being written into each of the pixel electrodes in such a manner that, given that either a level of a voltage applied to the counter electrode or a voltage level shifted by a predetermined potential from the level of the voltage applied to the counter electrode is taken as a reference potential, and further given that polarity of the signal potential compared with the reference potential is defined as writing polarity, the writing polarity is reversed more than once in the field time period, and, in addition, the writing polarity of each of the plurality of sub field time periods making up a certain field time period is the opposite of the writing polarity of the corresponding one of the plurality of sub field time periods making up the next field time period. In the plurality of field time periods successive in time series with alternation of odd fields and even fields, a first total length of the sub field time periods in which writing in one polarity is performed in each cycle of two consecutive fields one of which is an odd field and the other of which is an even field is a value different from a second total length of the sub field time periods in which writing in the other polarity is performed in the each cycle of two consecutive fields.

In the driving method according to the above aspect of the invention, the writing polarity is reversed more than once in the field time period. In addition, the writing polarity of each of the plurality of sub field time periods making up one of two consecutive field time periods is the opposite of the writing polarity of the corresponding one of the plurality of sub field time periods making up the other field time period. Specifically, the latter feature means that, for example, when a certain field time period is made up of four sub field time periods having the writing polarity of "++−−", the next field time period is made up of four sub field time periods having the writing polarity of "−−++". With the above features, the driving method according to the first aspect of the invention makes it possible to suppress flickers and direct-current components. The suppression of flickers is an advantage offered principally by the reversal of the writing polarity in the field time period. The suppression of direct-current components is an advantage offered by the polarities opposite to each other in the two consecutive fields. Besides the above advantages, since the first total length of the sub field time periods in which writing in one polarity is performed in each cycle of two consecutive fields-one of which is an odd field and the other of which is an even field is a value different from the second total length of the sub field time periods in which writing in the other polarity is performed in the each cycle of two consecutive fields, the driving method according to the first aspect of the invention offers another advantage of effectively avoiding the adverse effects of pushdown. Since there is a difference between the first and second total values, there occurs a kind of disequilibrium between the time period in which writing in one polarity is performed and the time period in which writing in the other polarity is performed. While anticipating the generation of some direct-current component, the disequilibrium makes it possible to offset a direct-current component caused by the effects of pushdown. As described above, the driving method according to the first aspect of the invention makes it possible to suppress a direct-current component caused by the effects of pushdown.

In the method of driving an electro-optical device according to the first aspect of the invention, the writing polarity should preferably be reversed each time of entering into the sub field time period during the one field time period. With such a preferred method, since the reversal of writing polarity in one field time period is comparatively frequent, it is possible to suppress flickers effectively.

In the preferred driving method, given that two consecutive sub field time periods make up each of a plurality of groups in the field time period, the plurality of groups included in the odd field time period may have an equal length of time, the plurality of groups included in the even field time period may have an equal length of time, each of the plurality of groups included in the odd field time period may have the same length of time as that of the corresponding one of the plurality of groups included in the even field time period, and, given that one of the two consecutive sub field time periods that make up the group in the field time period is taken as a reference length, a ratio pertaining to relative length of the two consecutive sub field time periods that make up the group included in the odd field time period may be a value different from a ratio pertaining to relative length of the two consecutive sub field time periods that make up the group included in the even field time period. On the premise of the use of a sub field as a unit of time for reversing writing polarity in the time period of one field, in the above method, a ratio pertaining to the relative length of time of two consecutive sub fields that make up a group included in an odd field is different from a ratio pertaining to the relative length of time of two consecutive sub fields that make up a group included in an even field. For example, when a certain group included in an odd field is made up of two sub fields having the writing polarity of "+−", a group that corresponds to the certain group and is included in an even field is made up of two sub fields having the writing polarity of "−+". Between a ratio pertaining to the relative length of time of the former two sub fields, which is denoted as "ratio A", and a ratio pertaining to the relative length of time of the latter two sub fields, which is denoted as "ratio B", the following relationship holds true: $A \neq B$ (not equal). The ratio A pertaining to the relative length can be expressed as, for example, the length of time of the negative sub field divided by that of the positive sub field (−/+). The ratio B pertaining to the relative length can be expressed as, for example, the length of time of the positive sub field divided by that of the negative sub field (+/−). In the above example, in each of the ratios A and B, the length of time of the first sub field in the group is taken as the reference length. That is, in each of the above fractions, the length of time of the first sub field in the group is taken as its denominator. Notwithstanding the above, however, the length of time of the second sub field in the group may be taken as the reference length. With the above relationship, since the plurality of groups has equal time periods, the difference between the first total value and the second total value is very natural. In addition, with the above method, the value of the difference between the first total value and the second total value can be set comparatively flexibly and easily by adjusting the ratio(s) only. Therefore, even in a case where it is difficult to estimate the effects of pushdown, with the above method, it is possible to make the effects less serious effectively by finding an optimal value of difference selectively among values of difference between the ratios. In the above method, for example, when an odd field is made up of groups Go1, Go2, . . . , GoN (N is a positive integer), and when an even field is made up of groups Ge1, Ge2, . . . , GeN, the phrase "a group that corresponds to ––– group" means, Ge1 corresponding to Go1, GeN corresponding to GoN, and the like.

In the driving method according to the first aspect of the invention, a difference should preferably be set between the first total length of the sub field time periods and the second total length of the sub field time periods to offset the occurrence of a direct-current component caused by a potential variation at the counter electrode that arises when the switching element is switched ON or OFF. With such a preferred method, since the difference between the first and second total values is set to offset the effects of pushdown, it is possible to make the effects less serious very effectively. The difference may be set automatically. Alternatively, it may be set manually. It can be set not only during the processes of manufacturing but also when an electro-optical device is actually used. As explained above, the preferred method described above has an advantage in that its flexibility as a measure for eliminating the adverse effects of pushdown is significantly enhanced. When the above method and the method explained immediately before the above method are used in combination, as will be understood from the foregoing description, the setting of the value of difference between the first and second total values is almost equivalent to the setting of the value of difference between the ratios.

The technical concept of the invention applied to the above driving method can be applied to an electro-optical device or an electronic apparatus as follows.

An electro-optical device according to a second aspect of the invention includes a plurality of scanning lines, a plurality of data lines, a plurality of pixels, a scanning line driving section, and a data line driving section. The pixels are provided at areas corresponding to respective intersections of the scanning lines and the data lines. Each of the pixels includes an electro-optical element and a switching element. The electro-optical element includes a pixel electrode, a counter electrode, and an electro-optical material sandwiched between the pixel electrode and the counter electrode. The switching element is provided between the pixel electrode and the data line. The switching element is controlled in such a manner that it is put into either an ON state or an OFF state. A scanning signal that is supplied through the scanning line is used for controlling the state of the switching element. The scanning line driving section sequentially supplies the scanning signal for putting the switching element into the ON state through the plurality of scanning lines in each of a plurality of sub field time periods. The plurality of sub field time periods make up a field time period, which is a period of time required for displaying one picture unit of an image. The scanning line driving section selects the pixels on a scanning-line-by-scanning-line basis by sequentially supplying the scanning signal. The data line driving section writes a signal potential that indicates a voltage level for an image that is to be displayed into each of the pixel electrodes of the pixels selected by the scanning line driving section through the corresponding one of the plurality of data lines. The data line driving section writes the signal potential into each of the pixel electrodes in such a manner that, given that either a level of a voltage applied to the counter electrode or a voltage level shifted by a predetermined potential from the level of the voltage applied to the counter electrode is taken as a reference potential, and further given that polarity of the signal potential compared with the reference potential is defined as writing polarity, the writing polarity is reversed more than once in the field time period, and, in addition, the writing polarity of each of the plurality of sub field time periods making up a certain field time period is the opposite of the writing polarity of the corresponding one of the plurality of sub field time periods making up the next field time period. In the plurality of field time periods successive in time series with alternation of odd fields and even fields, the scanning line driving section sequentially supplies the scanning signal through the plurality of scanning lines in such a manner that a first total length of the sub field time periods in which writing in one polarity is performed in each cycle of two consecutive fields one of which is an odd field and the other of which is an even field is a value different from a second total length of the sub field time periods in which writing in the other polarity is performed in the each cycle of two consecutive fields.

In an electro-optical device according to the second aspect of the invention, it is preferable that the data line driving section should write the signal potential through the data line in such a manner that the writing polarity is reversed each time of entering into the sub field time period during the one field time period.

In such a preferred electro-optical device, the scanning line driving section may sequentially supply the scanning signal through the plurality of scanning lines in such a manner that, given that two consecutive sub field time periods make up each of a plurality of groups in the field time period, the plurality of groups included in the odd field time period has an equal length of time, the plurality of groups included in the even field time period has an equal length of time, each of the plurality of groups included in the odd field time period has the same length of time as that of the corresponding one of the plurality of groups included in the even field time period, and, given that one of the two consecutive sub field time periods that make up the group in the field time period is taken as a reference length, a ratio pertaining to relative length of the two consecutive sub field time periods that make up the group included in the odd field time period is a value different from a ratio pertaining to relative length of the two consecutive sub field time periods that make up the group included in the even field time period.

In such a preferred electro-optical device, the scanning line driving section may set a difference between the first total length of the sub field time periods and the Second total length of the sub field time periods to offset a potential variation at the counter electrode that arises when the switching element is switched ON or OFF.

An electronic apparatus according to a third aspect of the invention is provided with an electro-optical device according to the second aspect of the invention, including its preferred modes.

BRIEF DESCRIPTION OF THE DRAWINGS

The invention will be described with reference to the accompanying drawings, wherein like numbers reference like elements.

FIG. 4 is a diagram that schematically illustrates an example of a table that is looked up for ON/OFF conversion for each sub field.

DESCRIPTION OF EXEMPLARY EMBODIMENTS

Figure 1:
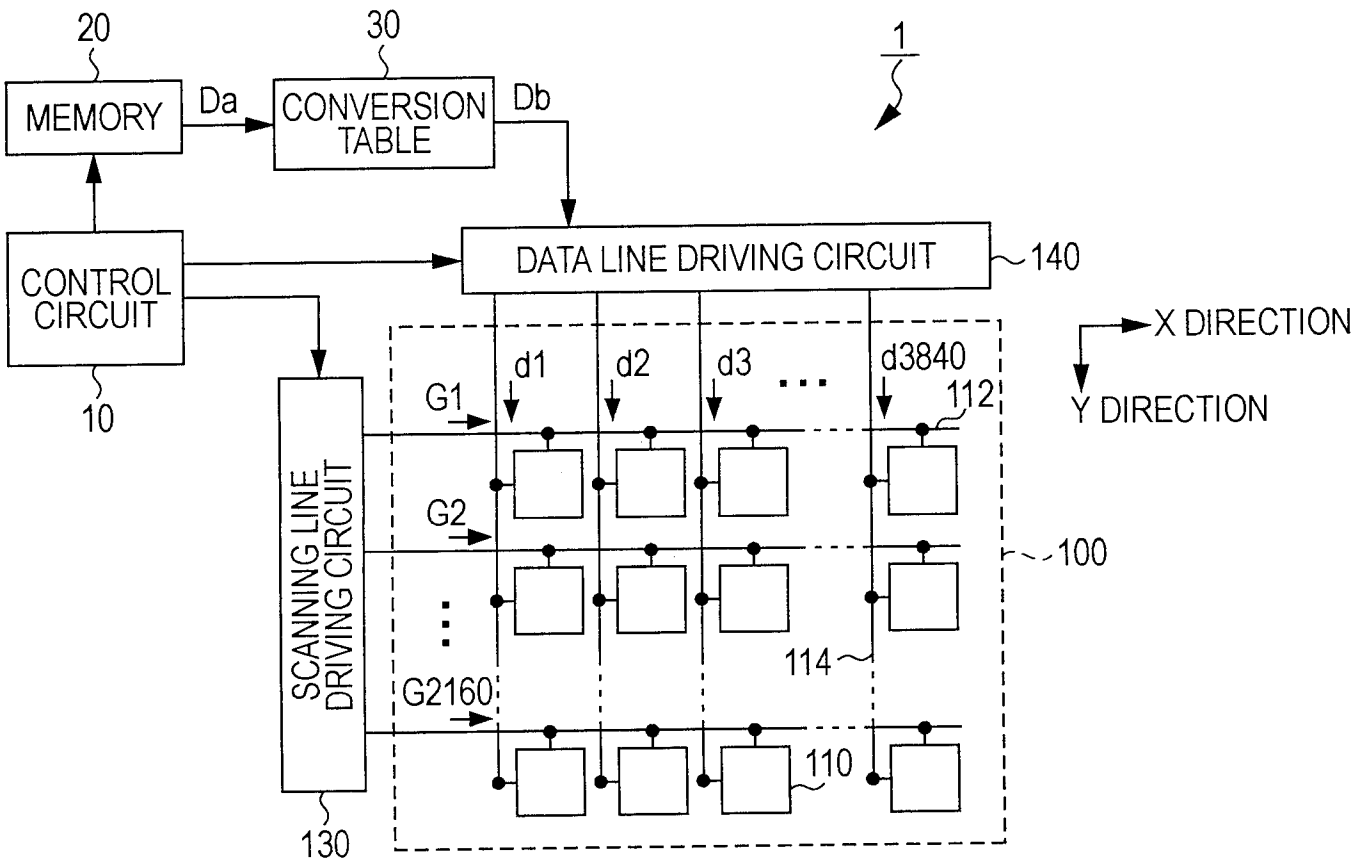
FIG. 1 is a block diagram that schematically illustrates an example of the overall configuration of an electro-optical device according to an exemplary embodiment of the invention.
Figure 2:
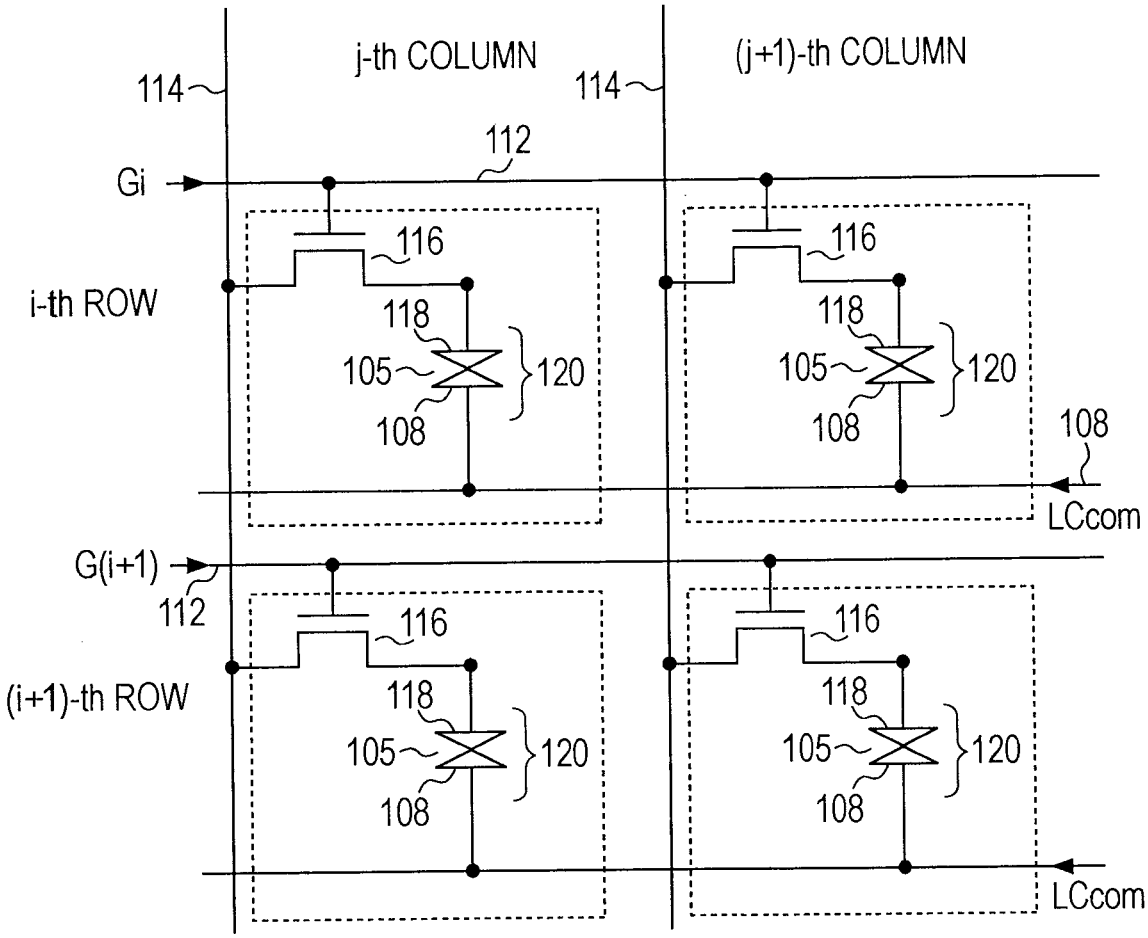
FIG. 2 is a diagram that schematically illustrates an example of the configuration of four pixels that are formed at 2×2 areas corresponding respectively to the intersections of an i-th row and an (i+1)-th row, which is next to the i-th row, and a j-th column and a (j+1)-th column, which is next to the j-th column.

With reference to FIGS. 1 and 2, an exemplary embodiment of the invention will now be explained. FIG. 1 is a block diagram that schematically illustrates an example of the overall configuration of an electro-optical device 1 according to an exemplary embodiment of the invention. As illustrated in FIG. 1, the electro-optical device 1 includes a control circuit 10, a memory 20, a conversion table 30, a display area 100, a scanning line driving circuit 130, and a data line driving circuit 140 as its main components. The control circuit 10 controls these components as will be described later.

A plurality of pixels is arranged in a matrix pattern in the display area 100. Specifically, a plurality of scanning lines (writing scan lines) 112 and a plurality of data lines 114 are formed in the display area 100. Each of the scanning lines 112 extends in the X direction, which is the horizontal direction in FIG. 1. Each of the data lines 114 extends in the Y direction, which is the vertical direction in FIG. 1. The scanning lines 112 and the data lines 114 are electrically insulated from each other. The number of rows of the scanning lines 112 is 2,160. The number of columns of the data lines 114 is 3,840. A pixel 110 is provided at an area corresponding to each of the intersections of the scanning lines 112 and the data lines 114. Therefore, in the present embodiment of the invention, the pixels 110 are arranged in the matrix pattern having 2,160 rows and 3,840 columns (2,160×3,840). However, the applicable scope of the invention is not limited to such an exemplary arrangement pattern.

The memory 20 has a storage area corresponding to each of the pixels 110 arranged in the 2,160×3,840 matrix. Each of the storage areas is used for storing display data Da for the corresponding pixel 110. The display data Da specifies the luminosity (i.e., gray scale level) of the pixel 110. In the present embodiment of the invention, the gray scale level is specified in sixteen integral steps from "0" inclusive to "15" inclusive. The gray scale level "0" refers to the lowest gray scale level, which is black. The luminosity of the pixel 110 increases as the gray scale level increases. The gray scale level "15" refers to the highest gray scale level, which is white. The display data Da is supplied from a host device, which is not illustrated in the drawings, to the electro-optical device 1. The received display data Da is stored in the storage area corresponding to the pixel 110 under the control of the control circuit 10. The display data Da corresponding to the pixel 110 that is to be scanned in the display area 100 is read out of the memory 20 under the control of the control circuit 10.

The conversion table 30 is looked up for converting the display data Da read out of the memory 20 into ON/OFF data Db on the basis of the gray scale level specified by the display data Da and on the basis of the sub field. The ON/OFF data Db is data that indicates whether an ON voltage or an OFF voltage should be applied to the pixel 110 (liquid crystal element). The data conversion will be explained later.

Pixel Configuration

Next, to facilitate the understanding of the present embodiment of the invention, the configuration of the pixel 110 will now be explained while referring to FIG. 2. FIG. 2 is a diagram that schematically illustrates an example of the configuration of the pixel 110 according to an exemplary embodiment of the invention. Four pixels 110 that are formed at 2×2 areas corresponding respectively to the intersections of the i-th row and the (i+1)-th row, which is next to the i-th row, and the j-th column and the (j+1)-th column, which is next to the j-th column, are shown therein. Herein, "i" and "i+1" are symbols used for generalizing the rows of the pixels 110. The symbol "i" denotes any integer that is larger than or equal to one. The symbol "i+1" denotes any integer that is not larger than 2,160. In like manner, "j" and "j+1" are symbols used for generalizing the columns of the pixels 110. The symbol "j" denotes any integer that is larger than or equal to one. The symbol "j+1" denotes any integer that is not larger than 3,840.

As illustrated in FIG. 2, each of the pixels 110 includes an n-channel type transistor (MOSFET) 116 and a liquid crystal element 120. Since the pixels 110 have the same configuration, the pixel 110 that is located at the area corresponding to the intersection of the i-th row and the j-th column is taken as an example in the following description. The gate electrode of the transistor 116 in the pixel 110 located at the area corresponding to the intersection of the i-th row and the j-th column (hereinafter referred to as "i-row j-column pixel") is connected to the scanning line 112 extending on the i-th row. The source electrode of the transistor 116 in the i-row j-column pixel 110 is connected to the data line 114 extending on the j-th column. The drain electrode of the transistor 116 in the i-row j-column pixel 110 is connected to a pixel electrode 118, which is provided as one end of the liquid crystal element 120. A counter electrode (i.e., opposite electrode) 108 is provided as the other end of the liquid crystal element 120. The counter electrode 108 is an electrode that is common to all of the pixels 110. In the present embodiment of the invention, the voltage level of the counter electrode 108 is kept at a level LCcom.

The scanning lines 112, the data lines 114, the transistors 116, the pixel electrodes 118, and the like are formed over an element substrate. The counter electrode 108 is formed on a counter substrate. The counter substrate is attached to the element substrate with a certain clearance therebetween. The electrode formation surface of the element substrate faces the electrode formation surface of the counter substrate. Liquid crystal 105, which is not illustrated in the drawings, is sealed in the gap between the element substrate and the counter substrate at the display area 100. Therefore, the liquid crystal element 120 according to the present embodiment of the invention has a structure in which the liquid crystal 105 is sandwiched between the pixel electrode 118 and the counter electrode 108. The liquid crystal display panel according to the present embodiment of the invention is an LCOS (Liquid Crystal on Silicon) panel that includes a semiconductor substrate as its element substrate, a transparent substrate made of glass or the like as its counter substrate, and the reflective-type liquid crystal element 120. Therefore, the control circuit 10, the memory 20, and the conversion table 30 may be formed over the element substrate besides the scanning line driving circuit 130 and the data line driving circuit 140.

A selection voltage (scanning signal) is applied to a scanning line 112 to turn on transistors 116 (switching elements) (into a conductive state). A data signal is supplied through a data line 114 to a pixel electrode 118 via a (the) transistor 116 turned on. As a result, a difference voltage that is a difference between the voltage level of the data signal and the level of the voltage LCcom applied to the counter electrode 108 is written into the liquid crystal element 120 corresponding to the intersection of the scanning line 112 to which the selection voltage is being applied and the data line 114 through which the data signal is being supplied. When a non-selection voltage is applied to the scanning line 112, the transistor 116 is turned off (into a non-conductive state). Though the transistor 116 is in the OFF state, the voltage written into the liquid crystal element 120 when the transistor 116 was in the ON state is kept at the liquid crystal element 120 because of capacitance.

In the present embodiment of the invention, the liquid crystal element 120 is set in a normally black mode. Therefore, the reflection factor of the liquid crystal element 120 (the transmission factor of the liquid crystal element 120, if the liquid crystal element 120 is configured as a transmissive-type element) changes toward a darker side (i.e., darkens) as the effective value of a difference voltage between the pixel electrode 118 and the counter electrode 108 decreases. In a state in which no voltage is applied, its color is almost black. In the present embodiment of the invention, either an ON voltage, which sets the difference voltage at a voltage that is not smaller than a saturation voltage, or an OFF voltage, which sets the difference voltage at a voltage that is not larger than a threshold voltage, is applied to the pixel electrode 118.

A reflection factor in the darkest state in a normally black mode is defined as a relative reflection factor 0%. A reflection factor in the brightest state in the normally black mode is defined as a relative reflection factor 100%. Among voltages that are applied to the liquid crystal element 120, a voltage of which the relative reflection factor is 10% is defined as an optical threshold voltage, whereas a voltage of which the relative reflection factor is 90% is defined as an optical saturation voltage. In a voltage modulation scheme (analog driving), it is designed that a voltage that is not larger than the optical saturation voltage should be applied to the liquid crystal 105 when the liquid crystal element 120 is in a half-tone (gray) display state. Therefore, the reflection factor of the liquid crystal 105 takes a value that is almost proportional to the applied voltage of the liquid crystal 105.

In contrast, in the present embodiment of the invention, two voltages only, which are an ON voltage and an OFF voltage, are used as voltages that are applied to the liquid crystal element 120 for grayscale display (i.e., tone display). Specifically, grayscale display according to the present embodiment of the invention is performed as follows; each field is divided into a plurality of sub fields; time for applying an ON voltage or an OFF voltage to the liquid crystal element 120 is allocated while using the sub field as a unit of time.

In the present embodiment of the invention, a voltage having a level that is equal to a saturation voltage multiplied by a coefficient ranging from 1 to 1.5 is used as an ON voltage. The reason why a voltage having the above level is used is that such a voltage is preferable in terms of improvement in liquid crystal response characteristics because rising in the liquid crystal response characteristics is almost proportional to the level of a voltage applied to the liquid crystal element 120. A voltage having a level that is not higher than the optical threshold voltage of the liquid crystal element 120 is used as an OFF voltage.

The actual reflection factor of the liquid crystal element 120 is approximately proportional to a value of integral of a time period during which an ON voltage is applied because of liquid crystal response. However, to simplify explanation, it may be hereinafter described as proportional to a time period during which an ON voltage is applied.

Sub Field Structure

Figure 3:
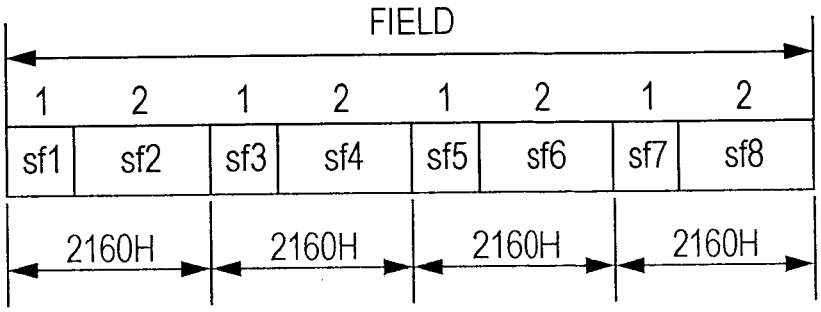
FIG. 3 is a diagram that schematically illustrates an example of the structure of sub fields.

Next, with reference to FIG. 3, the structure of sub fields according to the present embodiment of the invention is explained below. FIG. 3 is a diagram that schematically illustrates an example of the structure of sub fields in the electro-optical device 1 according to an exemplary embodiment of the invention. One field shown in FIG. 3 means a period of time that is required for forming one picture unit of an image. The term "field" is equivalent to frame in a non-interlace scheme. The length of one field is fixed at 16.7 milliseconds (which corresponds to 1/60 Hz).

As illustrated in FIG. 3, in the present embodiment of the invention, the time period of one field is divided into four equal groups. Each of the four groups is subdivided into two sub fields. Therefore, one field is divided into eight sub fields. For the purpose of explanation, the eight sub fields are denoted as sf1, sf2, sf3, . . . , and sf8 sequentially from the start of the field. Herein, if one cycle of a clock signal that is used for specifying the timing of dividing a field into sub fields is denoted as 1H, the length of time of one group can be denoted as 2,160H. Under the same assumption as above, the length of time of one field can be denoted as 8,640H (=2,160H×4) (Basically, the length of the cycle of a clock signal can be arbitrarily set. In addition, it is possible to arbitrarily design how the clock signal should be used to divide a field into sub fields. For these reasons, it goes without saying that specific values in actual implementation may differ from the exemplary values described herein). On the premise of the above denotation of the length of time of one field, the present embodiment of the invention has a unique feature in its approach to the setting of the length of time of each of sub fields that make up the field. A more detailed explanation of how the length of time of each sub field is set will be given later.

Content of Conversion Table

Next, with reference to FIG. 4, the content of the conversion table 30 used for performing grayscale display will now be explained. Gray scale levels and sub field (SF) codes are memorized in the conversion table 30 in association with each other. The SF code specifies either an ON voltage or an OFF voltage to be applied to the liquid crystal element 120 for each of the sub fields sf1 to sf8. Having the above content, the conversion table 30 is looked up for converting the display data Da read out of the memory 20 into the ON/OFF data Db, which indicates, for each of the sub fields sf1 to sf8, whether an ON voltage or an OFF voltage should be applied to the liquid crystal element 120. In FIG. 4, "1" indicates that an ON voltage should be applied to the liquid crystal element 120, whereas "0" indicates that an OFF voltage should be applied to the liquid crystal element 120. For example, if the gray scale level of the display data Da is "5", data specifying that an ON voltage should be applied to the liquid crystal element 120 in the sub fields sf2, sf5, and sf7 is outputted as the ON/OFF data Db. That is, it is specified that an OFF voltage should be applied to the liquid crystal element 120 in the sub fields other than sf2, sf5, and sf7. In the present embodiment of the invention, correspondences between the gray scale levels and the SF codes have been predetermined while taking liquid crystal response characteristics into consideration.

Figure 5:
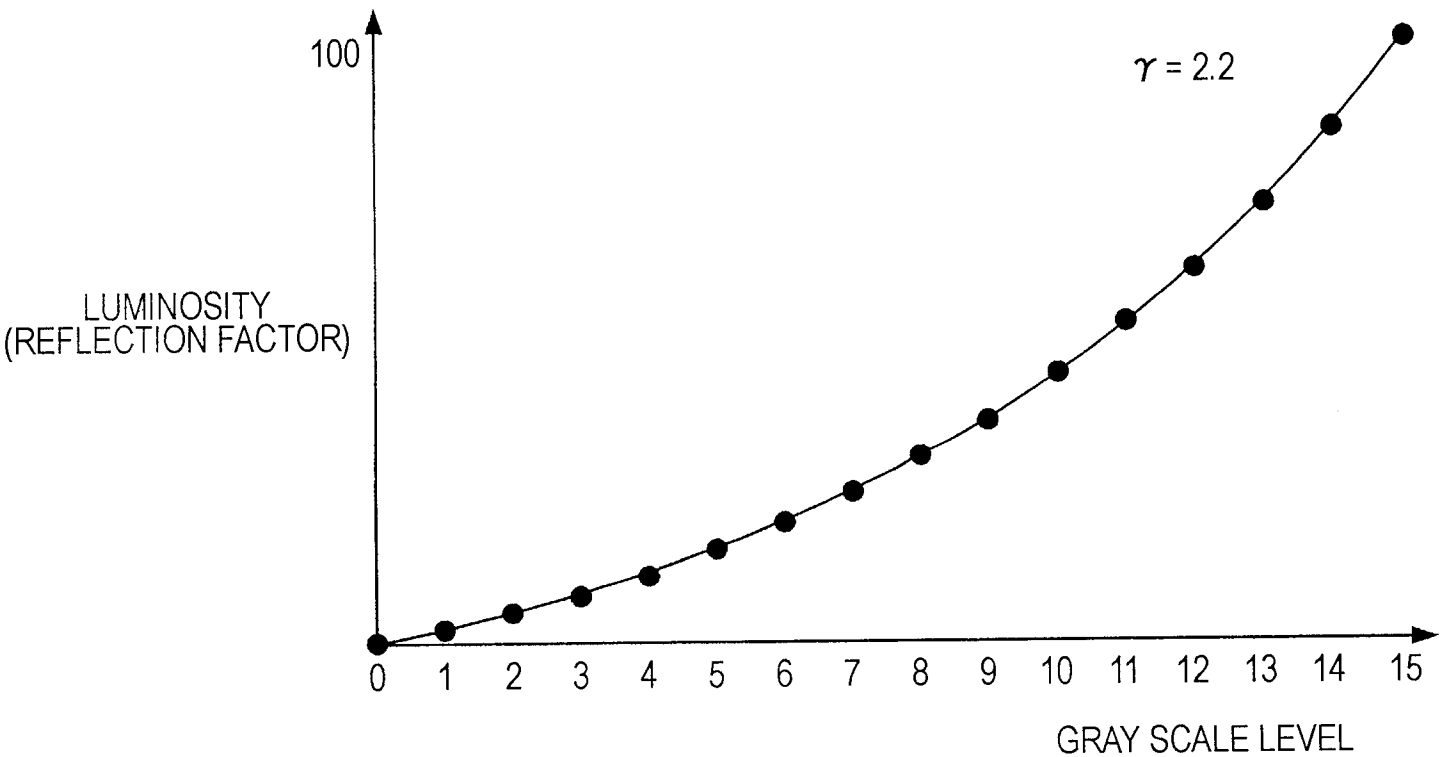
FIG. 5 is a graph that shows the grayscale characteristics of an electro-optical device.

It is generally known that the human eye has logarithmic or exponential visual characteristics. For this reason, even when a gray scale level changes linearly, it is sometimes perceived by the human eye that the change is nonlinear. In addition, even when a voltage or the like changes linearly, the actual luminosity of a display element such as a liquid crystal element, an organic electroluminescent (EL) element, and the like is nonlinear. In view of such nonlinear property, in the field of a display device, generally, a gray scale level specifying the tone of a pixel is converted into nonlinear characteristics (gamma characteristic) while taking human visual performance into consideration to specify the luminosity of a display element. With halftone display in accordance with gamma characteristic, a change in a gray scale level is perceived as linear by the human eye. When a liquid crystal element is employed as a display element, it is known that an ideal gamma coefficient in a gamma curve is 2.2. In the present embodiment of the invention, the conversion table 30 has preset conversion characteristics that ensure that, when it is looked up for converting the display data Da into the ON/OFF data Db, a relation of gray scale levels and luminosity levels illustrated in FIG. 5 will be obtained.

Scanning Line Driving Circuit

Next, the scanning line driving circuit 130 will now be explained in detail. The scanning line driving circuit 130 generates scanning signals C1, G2, . . . , G2160 that are enabled exclusively one after another in each of the sub fields sf1 to sf8. By this means, the scanning lines 112 are selected sequentially in ascending order. That is, the first scanning line is selected first, followed by the sequential selection of the second, third, fourth, . . . , 2159th, and 2160th scanning lines. When the scanning signals G1, G2, . . . , G2160 are enabled sequentially, the transistors 116 in the pixels 110 located on the first, second, third, fourth, . . . , 2159th, and 2160th rows are sequentially turned into an ON state. The plurality of pixels 110 is selected on a row-by-row basis as explained above. A data signal (signal potential) is written into a pixel electrode 118 through a data line 114. In the pixels 110 of each row, a period of time that corresponds to the sub field is a period from the selection of a scanning line corresponding thereto for the writing of either an ON voltage or an OFF voltage to the selection of the scanning line again.

Data Line Driving Circuit

Figure 6:
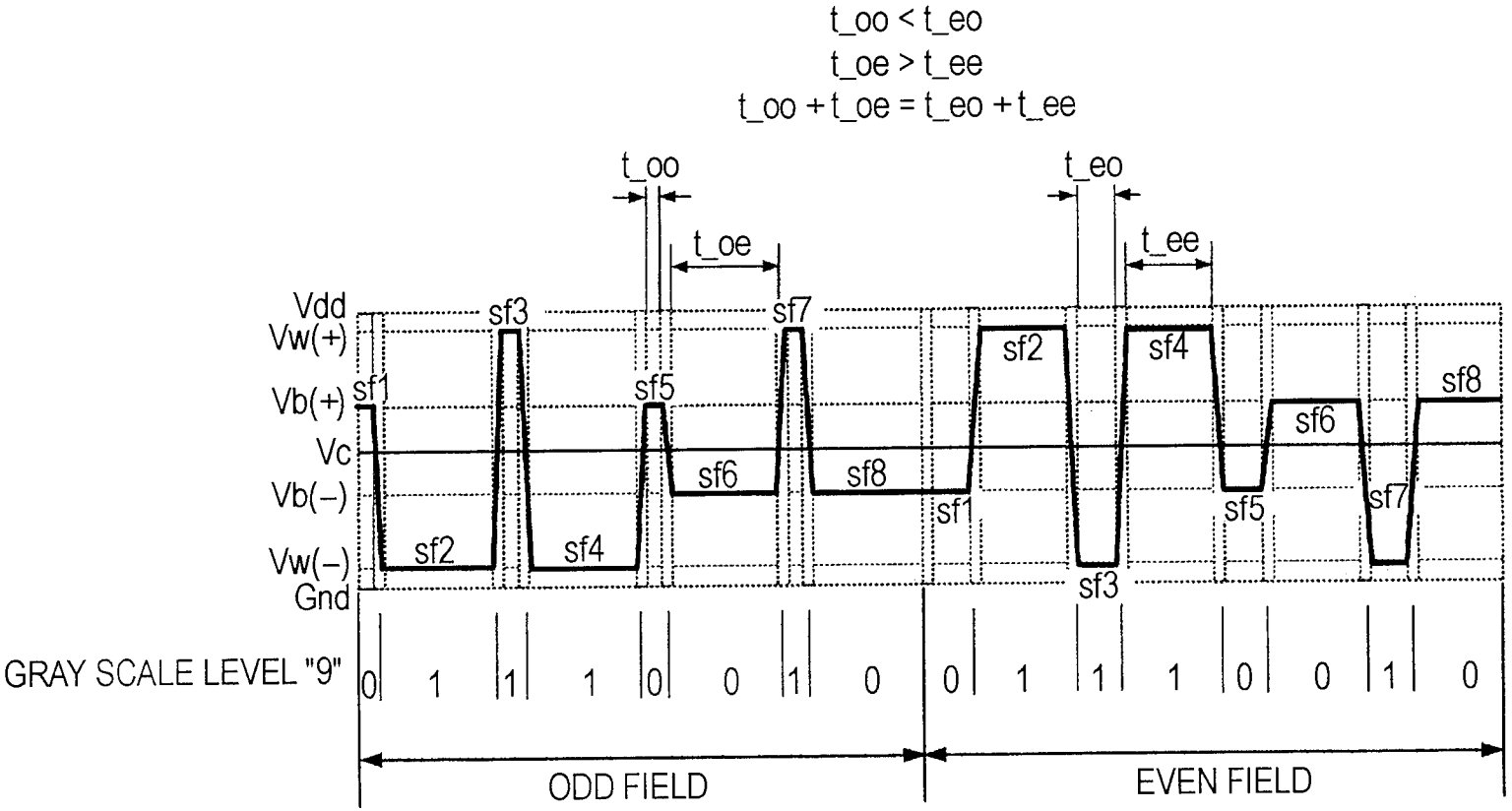
FIG. 6 is a diagram that schematically illustrates an example of a change in voltage P (i, j) of a pixel electrode in a liquid crystal element provided on the i-th row and the j-th column according to an exemplary embodiment of the invention.

Next, with reference to FIG. 6, the data line driving circuit 140 according to the present embodiment of the invention will now be explained. FIG. 1 is also referred to where necessary. FIG. 6 is a diagram that schematically illustrates an example of a change in voltage P (i, j) of the pixel electrode 118 in the liquid crystal element 120 provided on the i-th row and the j-th column according to an exemplary embodiment of the invention. In FIG. 6, it is assumed that the specified gray scale level is "9".

The data line driving circuit 140 converts the data Db converted with reference to the conversion table 30 into a voltage level having polarity specified by the control circuit 10. Then, the data line driving circuit 140 supplies it as a data signal through the data line 114 on the column corresponding to the data Db. Specifically, if the data Db converted with reference to the conversion table 30 specifies "1", which indicates that an ON voltage should be applied to the liquid crystal element 120, and further if writing in positive polarity is specified by the control circuit 10, the data line driving circuit 140 converts the table-converted data into a voltage level Vw(+). If the table-converted data specifies "1", and further if writing in negative polarity is specified by the control circuit 10, the data line driving circuit 140 converts the table-converted data into a voltage level Vw(−). On the other hand, if the data Db converted with reference to the conversion table 30 specifies "0", which indicates that an OFF voltage should be applied to the liquid crystal element 120, and further if writing in positive polarity is specified by the control circuit 10, the data line driving circuit 140 converts the table-converted data into a voltage level Vb(+). If the table-converted data specifies "0", and further if writing in negative polarity is specified by the control circuit 10, the data line driving circuit 140 converts the table-converted data into a voltage level Vb(−). In the following description, data signals supplied respectively through the first, second, third, . . . , 3840th data lines 114 are denoted as d1, d2, d3, . . . d3840. When the ordinal number of a column is not limited to any specific number, a data signal is denoted as dj, which refers to a data signal of the j-th column.

Each of the voltage levels Vw(+) and Vw(−) is a level for applying an ON voltage to the liquid crystal element 120. As illustrated in FIG. 6, the voltage levels Vw(+) and Vw(−) are symmetric with respect to a reference voltage Vc. In the present embodiment of the invention, since the common voltage LCcom is applied to the counter electrode 108 as explained earlier, a difference voltage that is a difference between the voltage level Vw(+) and the voltage level LCcom is applied as an ON voltage to the liquid crystal element 120 when the voltage Vw(+) is applied to the pixel electrode 118, whereas a difference voltage that is a difference between the voltage level Vw(−) and the voltage level LCcom is applied as an ON voltage to the liquid crystal element 120 when the voltage Vw(−) is applied to the pixel electrode 118. As explained earlier, a voltage having a level that is equal to a saturation voltage multiplied by a coefficient ranging from 1 to 1.5 is used as an ON voltage. Saturation response time from the application of the voltage Vw(+) or Vw(−) to the pixel electrode 118 to the reflection-factor saturation of the liquid crystal element 120 and resultant turning into white may be longer than the time period of the shortest sub field sf1. To put it the other way around, the time period of the sub field sf1 may be shorter than the saturation response time of the liquid crystal element 120.

On the other hand, each of the voltage levels Vb(+) and Vb(−) is a level for applying an OFF voltage to the liquid crystal element 120. As illustrated in FIG. 6, the voltage levels Vb(+) and Vb(−) are symmetric with respect to the reference voltage Vc. A difference voltage that is a difference between the voltage level Vb(+) and the voltage level LCcom is applied as an OFF voltage to the liquid crystal element 120 when the voltage Vb(+) is applied to the pixel electrode 118, whereas a difference voltage that is a difference between the voltage level Vb(−) and the voltage level LCcom is applied as an OFF voltage to the liquid crystal element 120 when the voltage Vb(−) is applied to the pixel electrode 118.

If a direct-current component were applied to the liquid crystal element 120, the liquid crystal 105 would deteriorate. To avoid the deterioration of the liquid crystal 105, a high-side potential, which is a voltage having a level higher than that of the reference voltage Vc, and a low-side potential, which is a voltage having a level lower than that of the reference voltage Vc, are applied alternately to the pixel electrode 118 (AC driving). In such AC driving, writing polarity predetermines whether to set the level of a voltage applied to the pixel electrode 118, that is, the voltage level of a data signal, higher than that of the reference voltage Vc or to set it lower than that of the reference voltage Vc. The polarity is defined as positive when the level of a voltage applied to the pixel electrode 118 is higher than that of the reference voltage Vc. The polarity is defined as negative when the level of a voltage applied to the pixel electrode 118 is lower than that of the reference voltage Vc. Control for the reversal of polarity according to the present embodiment of the invention for switching over from writing in positive polarity to writing in negative polarity, or from writing in negative polarity to writing in positive polarity, will be explained later.

Therefore, the voltages Vw(+) and Vb(+) are defined as voltages having positive polarity. The voltages Vw(−) and Vb(−) are defined as voltages having negative polarity. In the present embodiment of the invention, the voltage Vc is taken as a reference level for defining the polarity of writing. As for its voltage, unless otherwise specified, a ground potential Gnd, which corresponds to L of logic levels, is taken as voltage-zero reference.

Control for Reversal of Polarity and Sub Field Length Control

Figure 7:
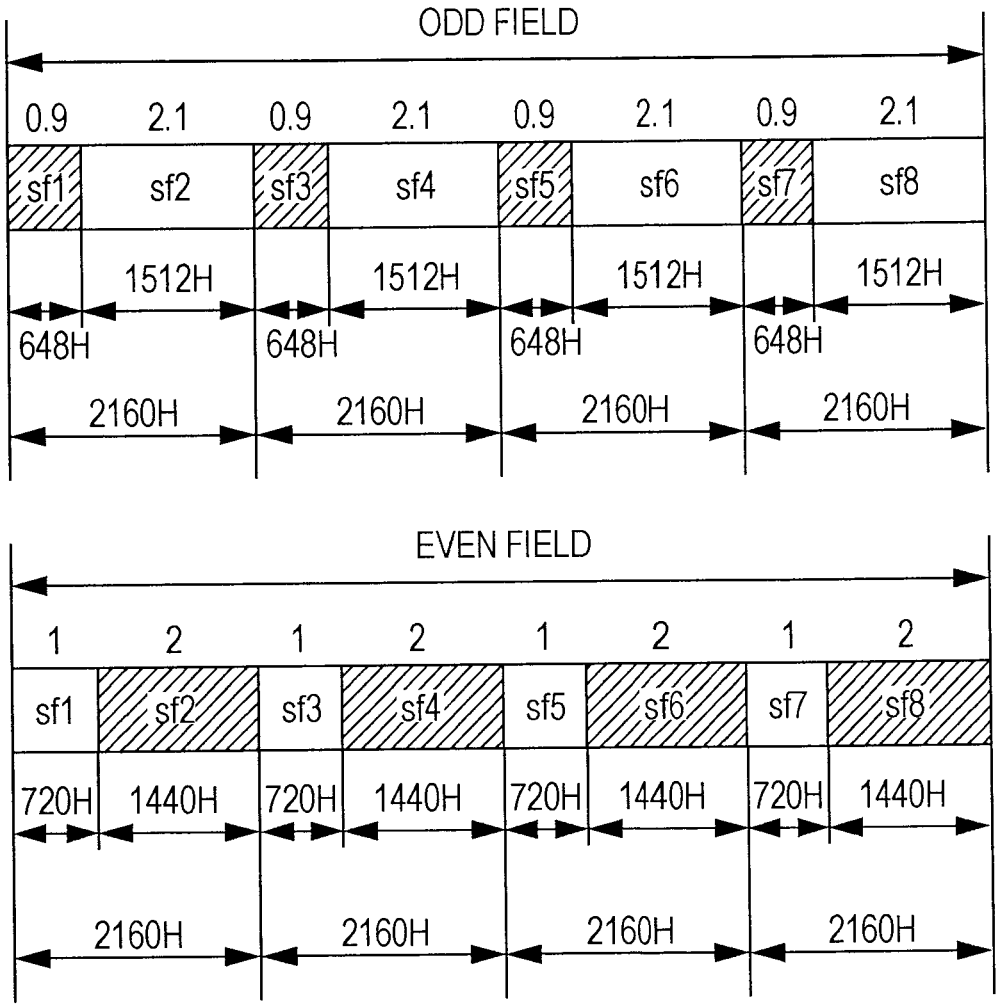
FIG. 7 is a diagram that schematically illustrates an example of a difference between the length of time of sub fields that make up an odd field and the length of time of sub fields that make up an even field according to an exemplary embodiment of the invention.
Figure 8:
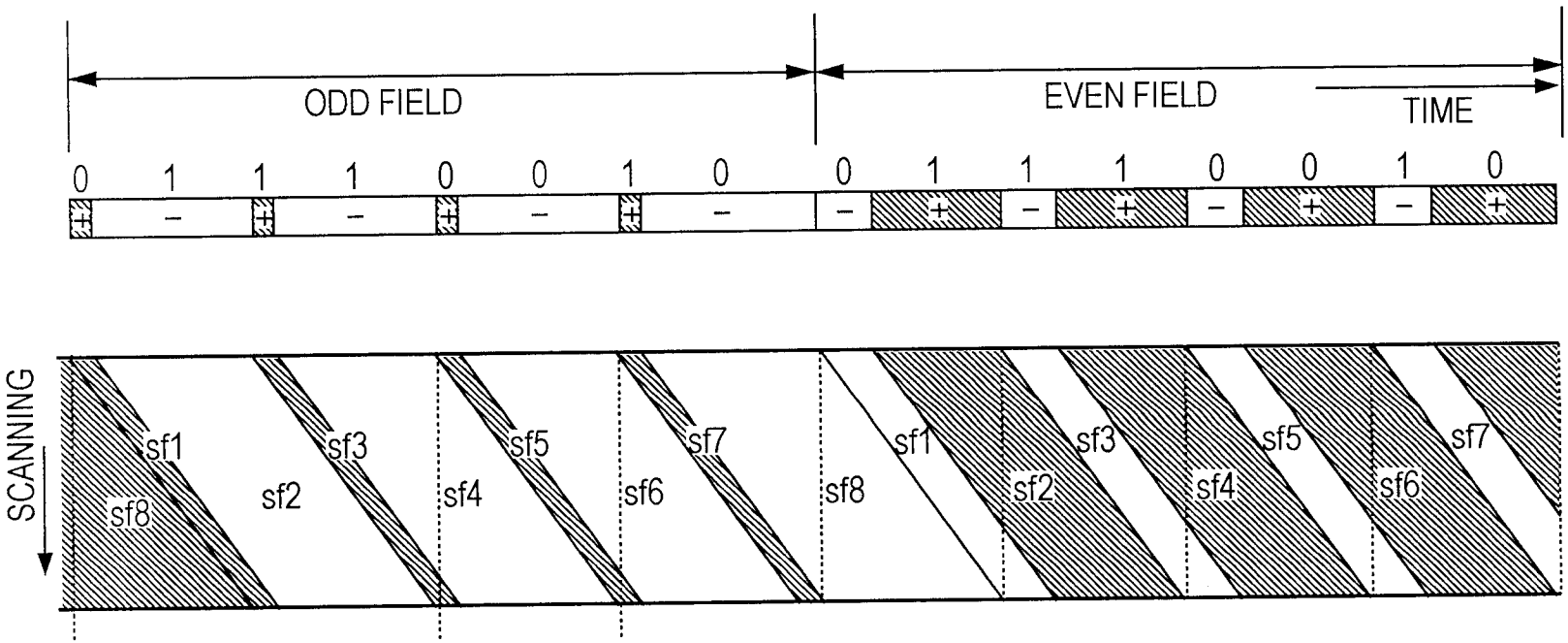
FIG. 8 is a diagram that schematically illustrates an example of the polarity of a signal potential in each sub field as well as progressive selection of scanning lines from the first row to the 2160th row according to an exemplary embodiment of the invention.

Next, control for the reversal of polarity according to the present embodiment of the invention will be explained in detail. The polarity-reversal control is performed for switching over from writing in positive polarity to writing in negative polarity or from writing in negative polarity to writing in positive polarity. In the following description, FIGS. 7 and 8 are referred to in addition to FIG. 6 explained above. FIG. 7 is a diagram that schematically illustrates an example of the structure of sub fields as well as the length of time of each sub field according to an exemplary embodiment of the invention. FIG. 8 is a diagram that schematically illustrates an example of the polarity of a signal potential in each sub field as well as progressive selection of scanning lines from the first row to the 2160th row according to an exemplary embodiment of the invention. As explained earlier, it is assumed that the specified gray scale level is "9" in FIG. 6. The same assumption holds true for FIG. 8. In FIG. 8, the symbol "+" denotes writing in positive polarity. The symbol "−" denotes writing in negative polarity.

As explained above, if writing in positive polarity is specified, the level of the voltage P (i, j) is either the voltage level Vw(+) for applying an ON voltage to the liquid crystal element 120 or the voltage level Vb(+) for applying an OFF voltage to the liquid crystal element 120 when the scanning signal Gi is in the H level. The voltage is maintained throughout the entire period of each sub field. If writing in negative polarity is specified, the level of the voltage P (i, j) is either the voltage level Vw(−) for applying an ON voltage to the liquid crystal element 120 or the voltage level Vb(−) for applying an OFF voltage to the liquid crystal element 120 when the scanning signal G1 is in the H level. The voltage is maintained throughout the entire period of each sub field.

As illustrated in FIG. 6, since it is assumed that the specified gray scale level is "9", an ON voltage is applied to the liquid crystal element 120 in the sub fields sf2, sf3, sf4, and sf7, whereas an OFF voltage is applied to the liquid crystal element 120 in the sub fields sf1, sf5, sf6, and sf8. In addition, as illustrated in FIG. 8, writing in positive polarity is specified for the sub fields sf1, sf3, sf5, and sf7 in an odd field, which means that writing in negative polarity is specified for the sub fields sf2, sf4, sf6, and sf8 in the odd field. The polarity specification of an even field is the opposite of that of the odd field. Specifically, writing in negative polarity is specified for the sub fields sf1, sf3, sf5, and sf7 in an even field, which means that writing in positive polarity is specified for the sub fields sf2, sf4, sf6, and sf8 in the even field.

Therefore, polarity is reversed more than once (eight times in this example) in every field. In addition, a data signal (signal potential) is written into a pixel 110 with polarity reversal control in such a manner that the writing polarity of each of the plurality of sub fields (sf1 to sf8) making up a certain odd field is the opposite of the writing polarity of the corresponding one of the plurality of sub fields (sf1 to sf8) making up the next field, which is an even field. Specifically, the writing polarity of the first sub field sf1 of the even field is the opposite of the writing polarity of the first sub field sf1 of the odd field because of polarity reversal. In like manner, the writing polarity of the second sub field sf2 of the even field is the opposite of the writing polarity of the second sub field sf2 of the odd field. The writing polarity of the third sub field sf3 of the even field is the opposite of the writing polarity of the third sub field sf3 of the odd field. The writing polarity of the fourth sub field sf4 of the even field is the opposite of the writing polarity of the fourth sub field sf4 of the odd field. The writing polarity of the fifth sub field sf5 of the even field is the opposite of the writing polarity of the fifth sub field sf5 of the odd field. The writing polarity of the sixth sub field sf6 of the even field is the opposite of the writing polarity of the sixth sub field sf6 of the odd field. The writing polarity of the seventh sub field sf7 of the even field is the opposite of the writing polarity of the seventh sub field sf7 of the odd field. Finally, the writing polarity of the eighth sub field sf8 of the even field is the opposite of the writing polarity of the eighth sub field sf8 of the odd field.

Therefore, as illustrated in FIG. 6, in the odd field, the level of the voltage P (i, j) is the voltage level Vw(+) throughout each of the periods of time corresponding to the sub fields sf3 and sf7, that is, each of the periods throughout which an ON voltage is applied to the liquid crystal element 120, and in addition, writing in positive polarity is specified. In the even field, the level of the voltage P (i, j) is the voltage level Vw(−) throughout each of the periods of time corresponding to the sub fields sf3 and sf7, that is, each of the periods throughout which an ON voltage is applied to the liquid crystal element 120, and in addition, writing in negative polarity is specified. In the odd field, the level of the voltage P (i, j) is the voltage level Vw(−) throughout each of the periods of time corresponding to the sub fields sf2 and sf4, that is, each of the periods throughout which an ON voltage is applied to the liquid crystal element 120, and in addition, writing in negative polarity is specified. In the even field, the level of the voltage P (i, j) is the voltage level Vw(+) throughout each of the periods of time corresponding to the sub fields sf2 and sf4, that is, each of the periods throughout which an ON voltage is applied to the liquid crystal element 120, and in addition, writing in positive polarity is specified.

On the premise of the above control for reversal of polarity, the present embodiment of the invention is characterized in that, as illustrated in FIGS. 6, 7, and 8 (especially in FIG. 7), there is a difference between the length of sub-field time periods in an odd field and the length of sub-field time periods in an even field. Specifically, the difference therebetween is as follows.

As explained earlier while referring to FIG. 3, the time period of one field is divided into four equal groups. Each of the four groups is subdivided into two sub fields. In addition, as explained earlier, the length of time of one group is 2,160H. The length of time of one field is 8,640H. Each field according to the present embodiment of the invention has the features explained above as field property common to all fields irrespective of whether the field is an odd field or an even field. In addition to the above common features, each field according to the present embodiment of the invention has distinctive features illustrated in FIG. 7, which vary depending on whether the field is an odd field or an even field. First of all, to explain the distinctive features, the length of time of each of odd-numbered sub fields (sf1, sf3, sf5, and sf7) in an even field is taken as length of reference. As the first distinctive feature, the time of each of even-numbered sub fields (sf2, sf4, sf6, and sf8) in the even field is twice as long as that of each of the odd sub fields in the even field. That is, the ratio of the length of time of an odd sub field to the length of time of an even sub field is one to two. Secondly, when the length of time of each of the odd sub fields in the even field is taken as length of reference, that is, 1, as described above, the length of time of each of odd sub fields (sf1, sf3, sf5, and sf7) in an odd field can be expressed as 0.9. Thirdly, the length of time of each of even sub fields (sf2, sf4, sf6, and sf8) in the odd field can be expressed as 2.1. That is, the second and third features can be generalized as follows. The period of time of each of odd sub fields (sf1, sf3, sf5, and sf7) in an odd field, which is denoted as t_oo, is shorter than the period of time of each of odd sub fields (sf1, sf3, sf5, and sf7) in an even field, which is denoted as t_eo. Conversely, the period of time of each of even sub fields (sf2, sf4, sf6, and sf8) in an odd field, which is denoted as t_oe, is longer than the period of time of each of even sub fields (sf2, sf4, sf6, and sf8) in an even field, which is denoted as t_ee (refer also to "t_oo<t_eo", "t_oe>t_ee" in FIG. 6). However, as explained earlier, the length of time of one group in an odd field is the same as the length of time of one group in an even field (refer also to "t_oo+t_oe=t_eo+t_ee" in FIG. 6). The features generalized above can be further paraphrased as follows. In an odd field, since the ratio of an even sub field to an odd sub field is 2.1 to 0.9, the former divided by the latter approximates to 2.3 (2.1/0.9). In an even field, since the ratio of an even sub field to an odd sub field is two to one, the former divided by the latter equals 2 (2/1).

Since each field according to the present embodiment of the invention has the features explained above, even when data having the same gray scale level is displayed, time of writing in positive/negative polarity explained above while referring to FIG. 8 and time of application of the voltages Vw(+), Vb(+), Vw(−), and Vb(−) explained above while referring to FIG. 6 differ depending on whether the field is an odd field or an even field. The difference between the odd field and the even field is illustrated therein. Note that the scale is modified in a reasonably exaggerated manner in FIGS. 6, 7, and 8 (especially in FIGS. 6 and 8) from an exact scale that is a faithful representation of "1:2" or "0.9:2.1" for the purpose of facilitating the understanding of the features explained above. Specifically, in the present embodiment of the invention, total time period in which writing in negative polarity is performed in each cycle of two consecutive fields one of which is an odd field and the other of which is an even field is: 4*t_oe+4*t_eo=4×1,512H+4×720H=8,928H. On the other hand, total time period in which writing in positive polarity is performed in each cycle of two consecutive fields one of which is an odd field and the other of which is an even field is: 4*t_oo+4*t_ee=4×648H+4×1,440H=8,352H. That is, in the present embodiment of the invention, the total time period in which writing in negative polarity is performed in each cycle of two consecutive fields is longer than the total time period in which writing in positive polarity is performed therein by 576H. If attention is focused on one group taken as a unit of time, the difference therebetween is 144H (=(1,512H+720H)−(648H+1,440H)).

The scanning line driving circuit 130 and the data line driving circuit 140 operate cooperatively to make the length of time different therebetween as explained above. Specifically, for example, the scanning line driving circuit 130 operates with predetermined "time for waiting" allocated to follow the selection of each scanning line 112 for sub fields (e.g., sub fields other than sub fields having the period of time t_oo in FIG. 7) that have the period of time longer than that of the shortest sub fields (e.g., sub fields having the period of time t_oo in FIG. 7). While taking the waiting time after the selection of each scanning line 112 into consideration, the data line driving circuit 140 supplies data signals through the data lines 114 each at an appropriate point in time.

With the above features, an electro-optical device according to the present embodiment of the invention can produce an advantageous effect of completely or almost completely removing a direct-current component from a voltage applied to the liquid crystal element 120 without any need to adjust the voltage LCcom applied to the counter electrode 108.

The occurrence of a so-called pushdown lies behind the production of such an advantageous effect. The pushdown (which is also called as "field-through" or "overrun") is a phenomenon of dropping in the voltage level of the drain electrode of the n-channel type transistor 116 (the pixel electrode 118) that occurs due to parasitic capacitance between the gate electrode and the drain electrode thereof when the switch state of the transistor 116 changes from ON to OFF as explained earlier. If no measure were taken against such a phenomenon, the effective value of a voltage applied to the liquid crystal element 120 during writing in negative polarity would be slightly larger than the effective value of a voltage applied to the liquid crystal element 120 during writing in positive polarity. Consequently, without any measure taken against such a phenomenon, a direct-current component would be generated as a predictable problem. To avoid such a problem, in related art, the level of the voltage LCcom applied to the counter electrode 108 is preset to be slightly lower than the level of the reference voltage Vc. An appropriate value that can offset the effects of pushdown is selected as the preset voltage level. By this means, it is possible to suppress the generation of a direct-current component to some extent.

However, such a solution of related art is sometimes not so effective in a practical sense. There are various reasons why the above solution might not be so effective practically. For example, according to the solution of related art, "the effects of pushdown" have to have been determined accurately in advance as a prerequisite for setting the voltage level of the counter electrode 108 at an appropriate value at least in principle. However, it is practically difficult to meet the preconditions. Moreover, it is not supposable that the voltage level of the counter electrode 108 will be changed from time to time depending on some circumstances. That is, once the counter voltage level is set, it cannot be changed as a general rule. This is partially because the changing of the counter electrode potential would have a significant impact on other settings and partially because it is uncertain whether the effects of pushdown could be really offset or not due to the reason described above even if the counter electrode potential were changed. To sum up the matter, the solution of related art has a disadvantage in that its flexibility as a measure for effectively avoiding the adverse effects of pushdown is rather limited.

In contrast, the solution of the present embodiment of the invention is basically free from the above problem. This is because, as explained above, in the present embodiment of the invention, the length of time of sub fields that make up an odd field and the length of time of sub fields that make up an even field are made different from each other. Such a difference offers a kind of disequilibrium between the time period in which writing in negative polarity is performed and the time period in which writing in positive polarity is performed as described above. The disequilibrium makes it possible to offset the effects of pushdown. That is, as explained above, the present embodiment of the invention makes it possible to remove a direct-current component from a voltage applied to the liquid crystal element 120 without any need to adjust the voltage LCcom applied to the counter electrode 108.

Moreover, the present embodiment of the invention offers another advantage in that it is very easy to adjust the degree of offsetting. The reason why offset adjustment is very easy is that the only thing needed for it is to properly adjust the length of time of sub fields. In practice, for example, the only thing needed for offset adjustment is a comparatively simple manipulation such as the adjustment of the length of waiting time from the completion of the scanning of all of the scanning lines 112 (or a scanning line 112) for a certain sub field to the starting of the scanning of all of the scanning lines 112 (or the next scanning line 112) for the next sub field. With such manipulation, the degree of a kind of disequilibrium between the time period in which writing in negative polarity is performed and the time period in which writing in positive polarity is performed varies. As the degree of disequilibrium changes, when a direct-current component is caused by pushdown, the magnitude of the direct-current component that will be subjected to offsetting changes. As explained above, the solution of the present embodiment of the invention has an advantage in that its flexibility as a measure for effectively avoiding the adverse effects of pushdown is significantly enhanced. This also means that the possibility of effectively avoiding the effects of pushdown is increased even when the effects of pushdown have not been determined accurately in advance. As will be understood from the above explanation, the specific values described as the length of time of sub fields in the present embodiment of the invention are illustrative only. Specifically, in the present embodiment of the invention, the relationship of the length of time between sub fields is explained as follows. The ratio of t_eo to t_ee is 1:2. The ratio of t_eo to t_oo is 1:0.9. The ratio of t_eo to t_oe is 1:2.1 (t_eo:t_ee:t_oo:t_oe is 1:2:0.9:2.1). However, the relationship of the length of time between sub fields is not limited to such an example. For example, various modified values such as "0.8:2.2", "0.95:2.05", or the like may be adopted for the ratio of t_oo to t_oe. The same holds true for t_eo to t_ee. However, it is preferable to set either one of an odd field and an even field as an invariable reference field from the viewpoint of avoiding the effects of pushdown by adjusting the length of time. Therefore, when applied to the specific example of the present embodiment of the invention, at least, it can be said that adjustment should preferably be made for the length of time of sub fields in an odd field only, that is, t_oo: t_oe.

Besides the above advantageous effects, the present embodiment of the invention produces other incidental effects because the number of times of polarity reversal is comparatively large in each field. As an example of other effects, it is possible to effectively suppress flickers on a screen.

Although an exemplary embodiment of the present invention is described above, an electro-optical device according to an aspect of the invention is not limited thereto. The invention can be modified in a variety of ways, several examples of which are described below.

Figure 9:
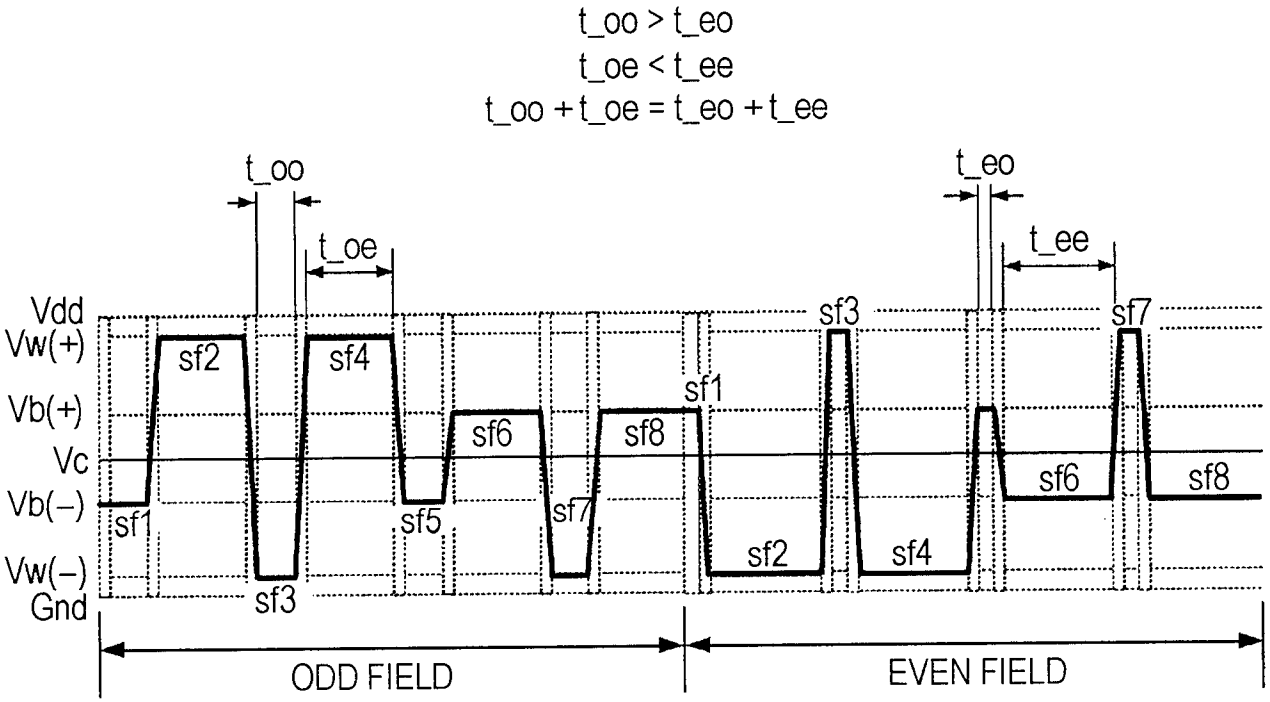
FIG. 9 is a diagram that schematically illustrates a variation example of the embodiment illustrated in FIG. 6.
Figure 10:
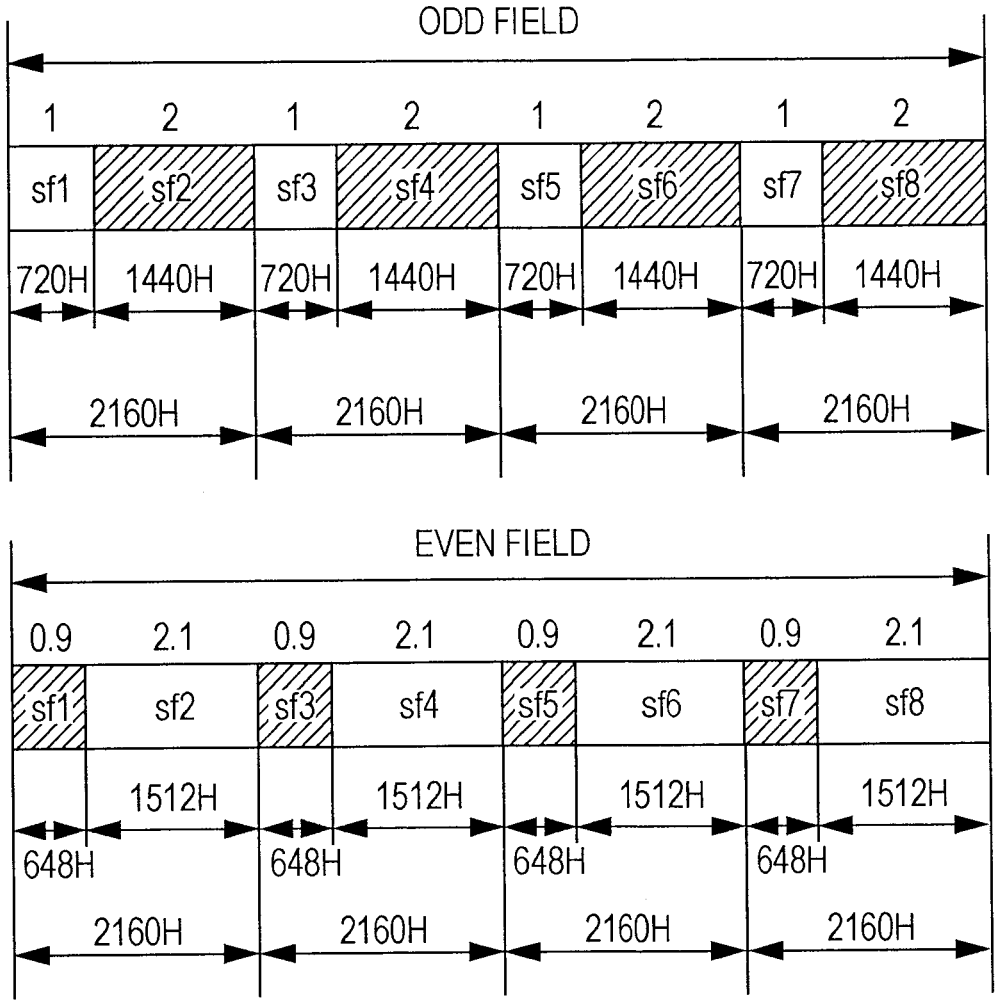
FIG. 10 is a diagram that schematically illustrates a variation example of the embodiment illustrated in FIG. 7.
Figure 11:
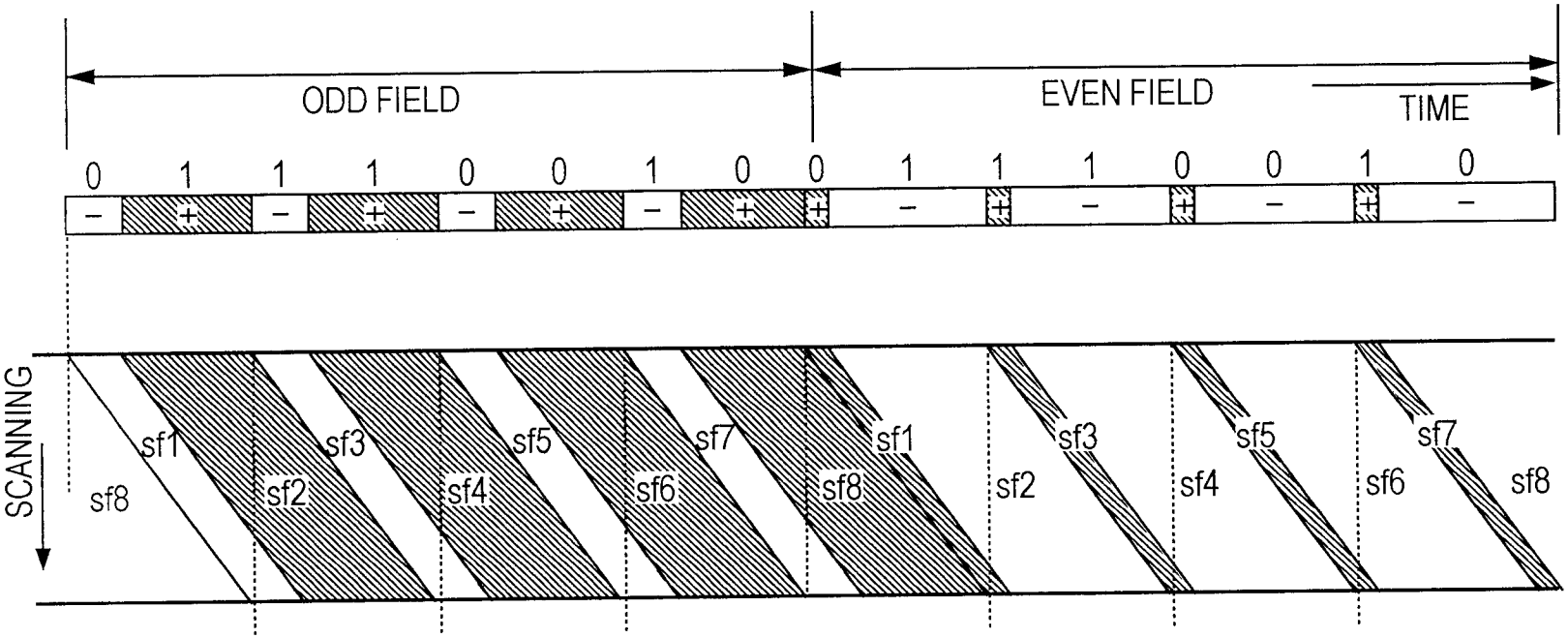
FIG. 11 is a diagram that schematically illustrates a variation example of the embodiment illustrated in FIG. 8.

(1) In the foregoing embodiment of the invention, it is explained that the following set of formulae holds true for the length of time of sub fields: t_oo<t_eo; and t_oe>t_ee. However, the scope of the invention is not limited to such an example. For example, the relationship of the length of time between sub fields may be modified from that of the foregoing embodiment of the invention by reversing an odd field and an even field as illustrated in FIGS. 9 to 11. Specifically, the ratio of the length of time of each of odd-numbered sub fields in an odd field, which is denoted as t_oo, and the length of time of each of even-numbered sub fields in the odd field, which is denoted as t_oe, may be one to two. In addition, the ratio of the length of time of each of odd-numbered sub fields in an even field, which is denoted as t_eo, and the length of time of each of even-numbered sub fields in the even field, which is denoted as t_ee, may be 0.9 to 2.1. The present invention encompasses such a variation example and the like. In the above variation example, it is preferable to set an odd field as an invariable reference field unlike the foregoing embodiment of the invention. Therefore, it is preferable that adjustment should be made for the length of time of sub fields in an even field only, that is, t_eo: t_ee.

(2) Though it is preferable to set either an odd field or an even field as an invariable reference field, the scope of the invention is not limited thereto. A mode according to which the length of time of sub fields constituting an odd field and the length of time of sub fields constituting an even field are changed at the same time is also encompassed within the scope of the invention. This is because, in some cases, there is no recourse but to make so-called concurrent adjustment all together for effectively avoiding the adverse effects of pushdown.

(3) In the foregoing embodiment of the invention, it is explained that polarity is reversed each time of entering into the time period of the sub field. However, the scope of the invention is not limited to such an exemplary mode. For example, assuming that the time period of one field includes the time periods of eight sub fields as in the field structure of the foregoing embodiment of the invention, the pattern of reversal of polarity in an odd field may be "++−−++−−". In such a variation example, it follows that the pattern of reversal of polarity in an even field is "−−++−−++". Note that such a modified pattern of reversal of polarity has points of sameness as the foregoing pattern of reversal of polarity in that writing polarity is reversed more than once during one field, and in addition, the writing polarity of each of sub fields that make up an odd field is the opposite of the writing polarity of the corresponding one of sub fields that make up an even field.

(4) In the foregoing embodiment of the invention, it is explained that the time period of one field is divided into four equal groups, each of which is subdivided into two sub fields. However, the scope of the invention is not limited to such an exemplary mode. For example, the invention can be applied to a field structure in which sub fields are weighted individually in terms of length. The field structure in which sub fields are weighted individually means a case where the length of time of sub fields in the time period of one field are different from one another unlike the foregoing embodiment of the invention illustrated in FIGS. 3, 6, and 7, according to which the length of time of each set of sub fields is the same. The following is an example of such a field structure in which sub fields are weighted individually. The time period of one field includes four sub fields. The length of time of the sub fields is preset to have the ratio of 1:2:4:8. Sub fields can be allocated in the time period of one field in various ways. In connection therewith, the length of time of the sub fields can be modified in various ways. The specific description of this specification and the illustration of the accompanying drawings are not intended to preclude the application of the invention to variations.

Application

Figure 12:
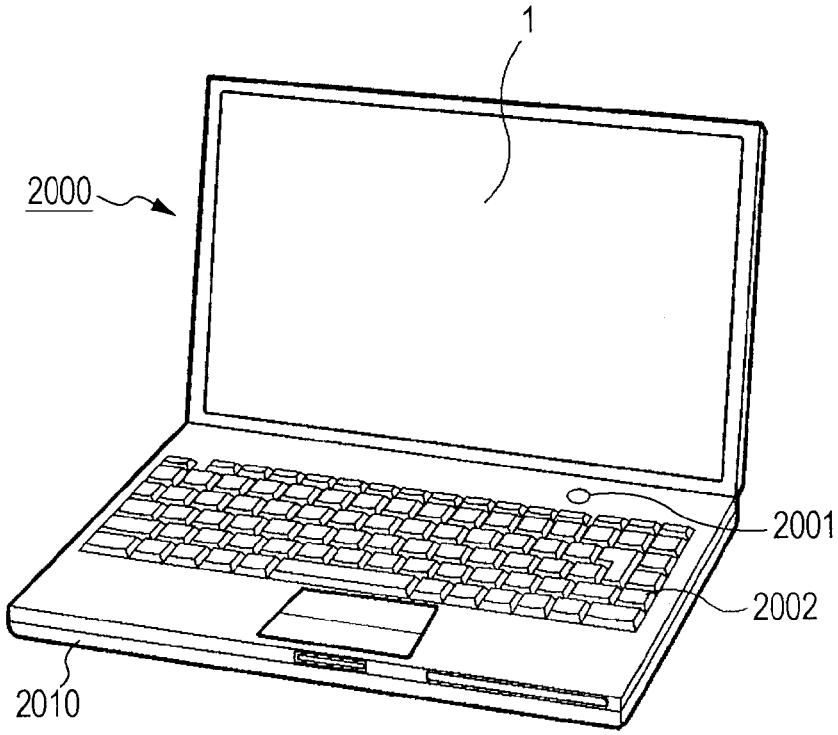
FIG. 12 is a perspective view that schematically illustrates an example of the appearance of an electronic apparatus to which an electro-optical device according to an exemplary embodiment of the invention is applied.
Figure 13:
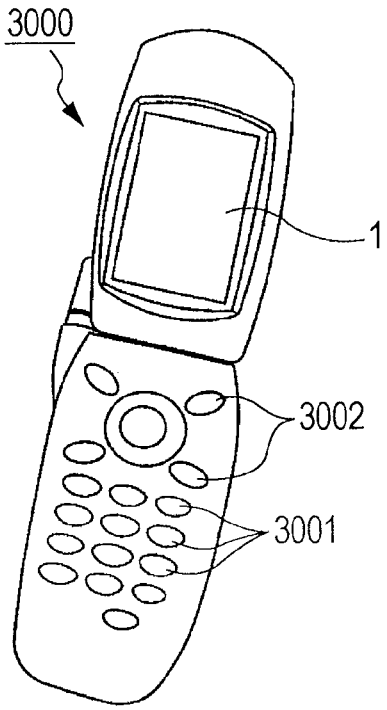
FIG. 13 is a perspective view that schematically illustrates another example of the appearance of an electronic apparatus to which an electro-optical device according to an exemplary embodiment of the invention is applied.
Figure 14:
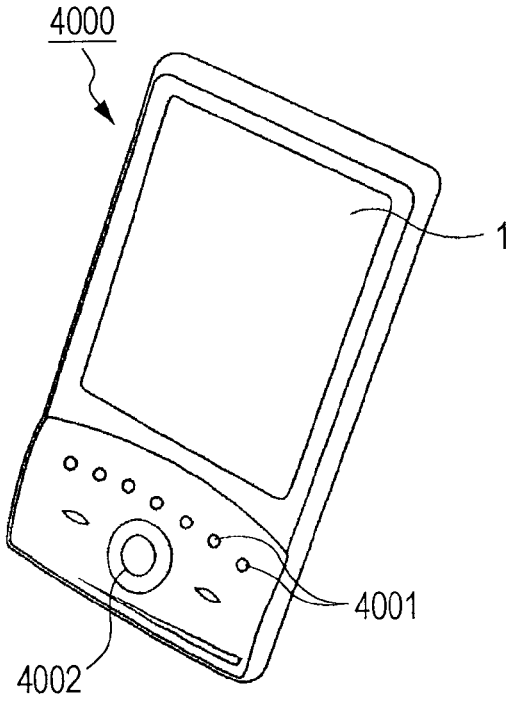
FIG. 14 is a perspective view that schematically illustrates still another example of the appearance of an electronic apparatus to which an electro-optical device according to an exemplary embodiment of the invention is applied.

Next, an explanation is given below of a few examples of a variety of electronic apparatuses to which an electro-optical device according to an aspect of the invention is applied. FIG. 12 is a perspective view that schematically illustrates an example of the configuration of a mobile personal computer that uses, as its image display device, an electro-optical device according to the foregoing embodiment of the invention. A personal computer 2000 includes the electro-optical device 1, which functions as a display device, and a mainframe 2010. The mainframe 2010 is provided with a power switch 2001 and a keyboard 2002. FIG. 13 illustrates an example of the configuration of a mobile phone to which an electro-optical device according to the foregoing embodiment of the invention is applied. A mobile phone 3000 is provided with a plurality of manual operation buttons 3001, scroll buttons 3002, and the electro-optical device 1 functioning as a display device. When a user operates the scroll buttons 3002, content displayed on the screen of the electro-optical device 1 is scrolled. FIG. 14 illustrates an example of the configuration of a personal digital assistant (PDA) to which an electro-optical device according to the foregoing embodiment of the invention is applied. A personal digital assistant 4000 is provided with a plurality of manual operation buttons 4001, a power switch 4002, and the electro-optical device 1 functioning as a display device. When a user turns the power switch 4002 on and operates the manual operation buttons 4001, various kinds of information including but not limited to an address list and a schedule table are displayed on the electro-optical device 1.

Among a variety of electronic apparatuses to which an electro-optical device according to an aspect of the invention is applicable are, besides the above electronic apparatuses illustrated in FIGS. 12, 13, and 14, a digital still camera, a television, a video camera, a car navigation device, a pager, an electronic personal organizer, electronic paper, an electronic calculator, a word processor, a workstation, a videophone, a POS terminal, a video player, a touch-panel device, and so forth.

The entire disclosure of Japanese Patent Application No. 2009-259743, filed Nov. 13, 2009 is expressly incorporated by reference herein.

What is claimed is:

1. An electro-optical device, comprising:

scanning lines;

data lines;

pixels provided at areas corresponding to respective intersections of the scanning lines and the data lines, each of the pixels including a pixel electrode and a switching element;

a scanning line driving section configured to sequentially supply a scanning signal for putting the switching element into an ON state through the scanning lines in each of sub field time periods, wherein the sub field time periods make up a field time period, the field time period is a period of time required for displaying one picture unit of an image, and the scanning line driving section is configured to select the pixels on a scanning-line-by-scanning-line basis by sequentially supplying the scanning signal; and a data line driving section configured to apply a signal potential into each of the pixel electrodes of the pixels selected by the scanning line driving section through the corresponding one of the data lines, wherein a polarity of the signal potential compared with a predetermined potential is defined as a writing polarity, and the data line driving section is configured to apply the signal potential in such a manner that the writing polarity is reversed more than once in the field time period, and the writing polarity of each of the sub field time periods making up a certain field time period is opposite to the writing polarity of the corresponding one of the sub field time periods making up the next field time period, wherein in the field time periods successive in time series with alternation of odd fields and even fields, the scanning line driving section is configured to sequentially supply the scanning signal through the scanning lines in such a manner that a first total length of the sub field time periods in which writing in one polarity is performed in each cycle of two consecutive fields including one odd field and one even field is different from a second total length of the sub field time periods in which writing in the other polarity is performed in the each cycle of two consecutive fields, two consecutive sub field time periods make up each of groups in the field time period, and the scanning line driving section is configured to sequentially supply the scanning signal through the scanning lines in such a manner that the groups included in the odd field time period have an equal length of time, the groups included in the even field time period have an equal length of time, each of the groups included in the odd field time period has the same length of time as that of the corresponding one of the groups included in the even field time period, a first ratio of respective lengths of the two consecutive sub field time periods that make up the group included in the odd field time period is different from a second ratio of respective lengths of the two consecutive sub field time periods that make up the group included in the even field time period, wherein the first ratio of respective lengths that make UP each of the groups included in the odd field time period have an equal ratio, and wherein the second ratio of respective lengths that make UP each of the groups included in the even field time period have an equal ratio.

2. The electro-optical device according to claim 1, wherein the scanning line driving section is configured to set a difference between the first total length of the sub field time periods and the second total length of the sub field time periods to offset a potential variation that arises when the switching element is switched ON or OFF.

3. An electronic apparatus, comprising the electro-optical device according to claim 1.

* * * * *